United States Patent [19]

Corain et al.

[11] Patent Number: 5,046,533

[45] Date of Patent: Sep. 10, 1991

[54] LOOM REED WITH PREASSEMBLED PACKS OF BLADE

[75] Inventors: Luciano Corain; Gianni Maitan, both of Vicenza; Renato Perlini, Verona; Giulio Bortoli, Schio, all of Italy

[73] Assignee: Nuovopignone-Industrie Meccaniche E Fonderia S.p.A., Florence, Italy

[21] Appl. No.: 436,240

[22] Filed: Nov. 14, 1989

[30] Foreign Application Priority Data

Nov. 25, 1988 [IT] Italy ..... 22733 A/88

[51] Int. Cl.[5] ..... D03D 49/62

[52] U.S. Cl. ..... 139/192

[58] Field of Search ..... 139/435.6, 192, 436, 139/457, 458, 460

[56] References Cited

U.S. PATENT DOCUMENTS

| | | | |
|---|---|---|---|
| 2,901,004 | 8/1959 | Kaufmann | 139/192 |
| 4,378,820 | 4/1983 | Lileev et al. | 139/436 |
| 4,458,730 | 7/1984 | Benelli | 139/192 X |
| 4,771,813 | 9/1988 | Gaisser | 139/192 |
| 4,844,131 | 7/1989 | Anderson et al. | 139/192 |

*Primary Examiner*—Andrew M. Falik

*Attorney, Agent, or Firm*—Morgan & Finnegan

[57] ABSTRACT

A bladed loom reed comprising a support base onto which are placed a series of preassembled packs of blades. Each preassembled pack has blades fixed to an auxiliary support and the bladed loom reed is formed by combining the packs on a support base with or without intermediate spacers between packs.

8 Claims, 2 Drawing Sheets

LOOM REED WITH PREASSEMBLED PACKS OF BLADE

This invention relates to a loom reed in the form of preassembled packs of blades with or without spacers, which besides being very economical to construct and extremely simple to assemble and maintain, allows optimun accuracy in the positioning of the blades themselves, as is particularly requested in the case of multi-phase looms in which the blades or dents of the fixed reed must always be perfectly aligned with the blades of the rotating reed. In this respect, in multi-phase looms it is known to use two separate reeds, of which one is fixed for the purpose of spacing the warp yarns equidistantly apart by means of its blades or dents, and the other rotates in order, by virtue of the particular shape of its blades between which the wrap yarns pass, to accompany the weft yarn and beat it against the edge of the already formed fabric. In order not to allow any wrap yarn deviation, which would result in an intolerably defective fabric, the respective blades of the two said reeds must be perfectly aligned with each others and thus in exactly predetermined position.

For this reason, during the construction of each said reeds the pitch between the blades must be kept rigorously constant and equal to the theoretical pitch, over the entire reed lenght.

The reeds are currently constructed by stacking on base support alternating blades and spacers which suffer from instrinsic constructional tolerances, especially in their thickness, with the result that after a certain number of elements have been mounted an inevitable considerable variavility in the blade positions arises.

In the known art, in order to obviate this drawback, the support bases of reeds for multi-phase looms are provided with fixed locating devices at distances apart which are a perfect multiple of the theoretical blade pitch, these enabling positioning errors to be identified and the exact predetermined blade position reset. More especifically, in the rotating reed these fixed locating devices are nothing more than grooves for housing snap shoulder rings, the purpose of which is to limit the stacking to a predetermined constant number of blade-spacer elements. If it is found possible to stack a number of elements different from the predetermined number, a blade positioning error is indicated. This known method has however a series of drawbacks both of a technical nature and a time-consuming and thus cost nature, the most important of which derives from the fact that the precise stacking can only be attained after successive attempts. These require all the already stacked blades and spacers to be removed one by one and totally or partly replaced by like elements of suitably different thickness, with a consequent considerable time loss and the need to use qualified personnel, and resultant high costs augmented by the need to provide said fixed locating devices on the support base.

A further drawback is due to the fact that each time the reed lenght requires changing to produce shorter or longer length fabrics, as is sometimes the case in weaving, it becomes neccessary to either remove or add blades, this being an operation which is not easy to carry out as it requires considerable accuracy and precision and therefore the use of qualified personnel to modify the reed, and in addition takes considerable time, involving consequent machine shut-downs and high costs.

A similar situation arises whenever a damaged blade has to be replaced.

Finally, further drawback with a consequent cost increase arises from the individual nature of the reed support base, which differs according to the required warp density in that if the blade pitch is changed, the distance between the fixed locating devices provided on said supports has to be correspondingly varied.

The object of the present invention is to obviate said drawbacks by providing a loom reed offering high blade positioning precision without the need for fixed locating devices and thus with a standart support base, considerable ease of manufacture with consequent low costs, and simple and rapid maintenance in the case of blade deterioration This is attained substantially in that the reed is formed by combining packs each consisting of a succession of blades which are preassembled, with or without intermediate spacers, by being welded or bonded either together or to at least one auxiliary support, said packs being of predetermined length.

The advantages of such a construction are immediately apparent.

Firstly, there is considerable blade positioning precision in that any positioning inaccuracy is now determined by the number of packs used, this being considerably less than the number of blades used. Again, the reed assembly time is considerably reduced by virtue of the small number of elements to be assembled, with consequent cost reduction. Any required change in reed length or damaged blade replacement are now easily implemented by simply dealing with specific packs, which can be quickly interchanged.

Any support base used to connect together the individual packs is in this case only an economical standard support, without the need for fixed locating devices to be provided in it for positioning purposes. A further advantage is that the reed can be dispatched more simply and cheaply, as it can be sent to a customer not in a single piece as is currently the case, but broken down into its constituent elements.

The invention is described in more detail hereinafter with reference to the accompanying drawings which show a preferred embodiment thereof by way of non-limiting example in that technical, technological and constructional modifications can be made thereto but without leaving the scope of the present invention. Thus instead of being applied to the fixed and rotating reeds of a multi-phase loom as illustrated in the figures, it is apparent that the invention can be applied to any loom reed, and that the blades can be preassembled not only by being welded or bonded together or to an auxiliary support, but by any other method.

Figure 1:
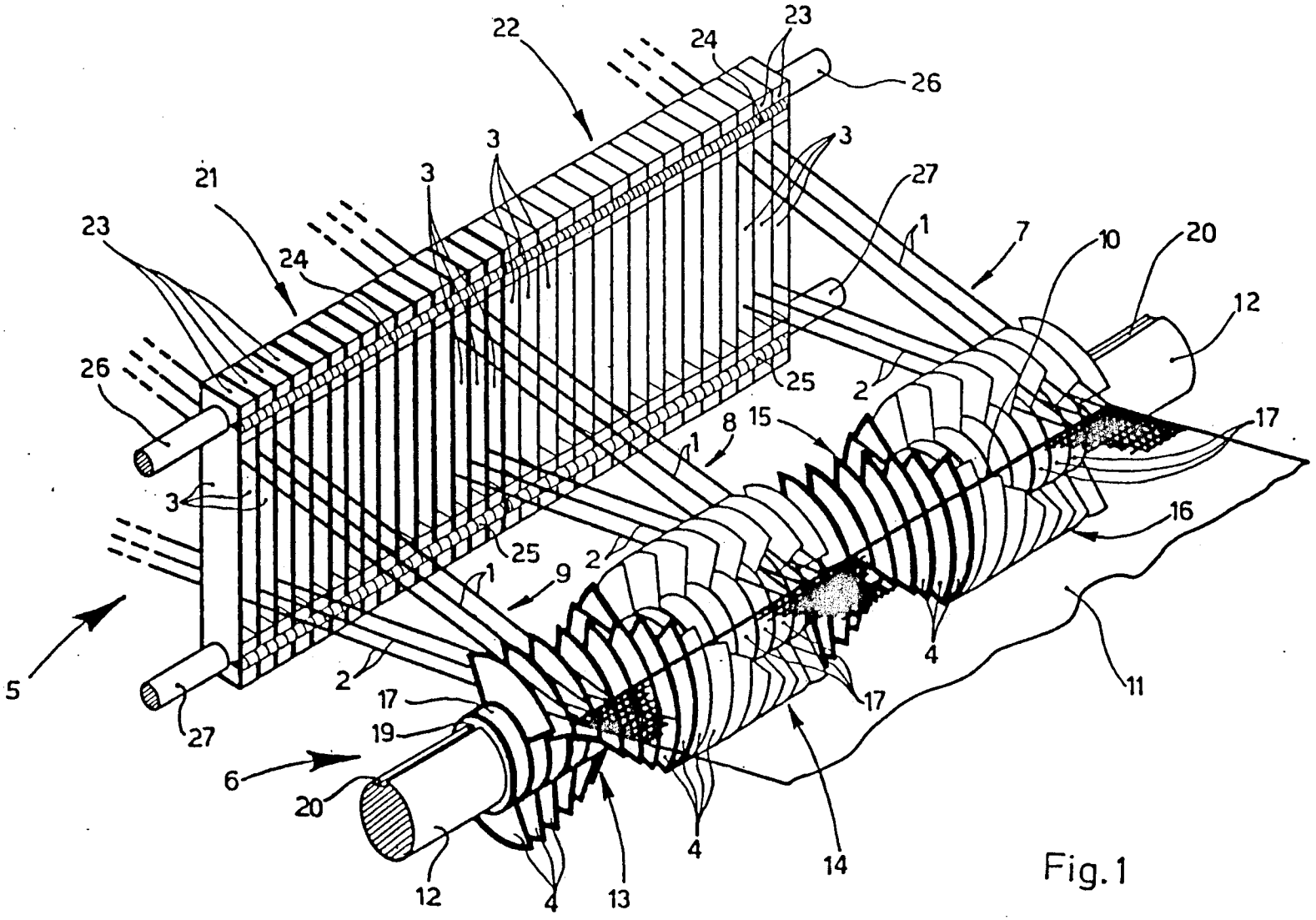
FIG. 1 is partial perspective view of the two fixed and rotating reeds of a multi-phase loom constructed in accordance with the invention.

In the figures, the reference numeral 1 indicates the upper warp yarns and 2 the lower warp yarns of a multi-phase loom, not shown in the figure, which by passing through the blades 3 and 4 of respectively the fixed reed 5 and rotating reed 6 of said multi-phase loom, form the successive sheds 7, 8 and 9 into which the weft yarns, not shown in the figure, are inserted to be beaten up by the rotating reed 6 against the edge 10 of the forming fabric 11.

Figure 2:
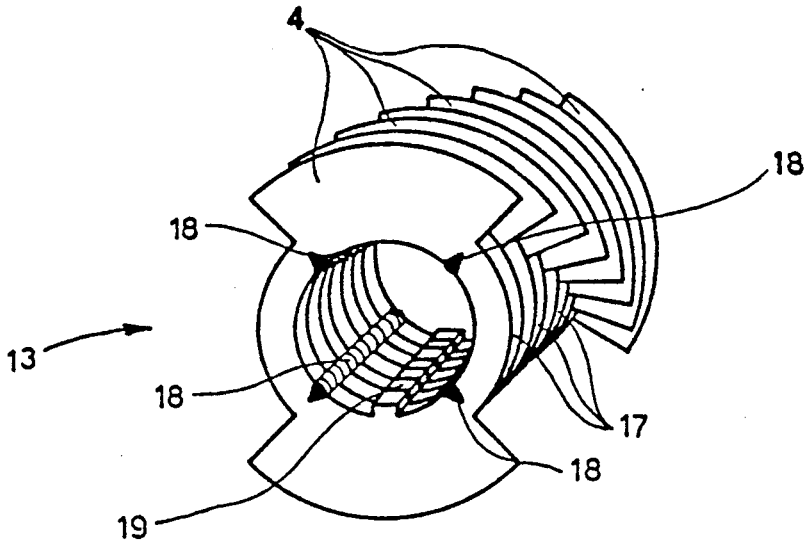
FIG. 2 is a perspective view to an enlarged scale of one of the constituent prefabricated packs of the rotating reed of FIG. 1.

Said rotating reed 6 is constructed according to the invention by placing together on a central support 12 a series of packs 13, 14, 15 and 16 (four packs in FIG. 1 in which the different packs are shown by lines of different thickness for their easier identification) of predetermined length, each of which (see specifically FIG. 2) consists of a succession of internally supported blades 4 (eight in the figure) and intermediate spacers 17 which are preassembled by means of weld seams 18 provided in suitable cavities formed directly during the punching of said blades and spacers. Said punching operation also forms the positioning tabs 19 which cooperate with a guide groove 20 in said central support 12 in order to set the blades 4 in a helical arrangement as is clearly visible in FIG. 1.

The fixed reed 5 consists according to the invention of two packs 21 and 22 of blades 3 and spacers 23 fixed together by external weld seams 24 and 25 along their upper and lower edges, at which the packs comprise through bores for the two removable connection pins 26 and 27.

Figure 3:
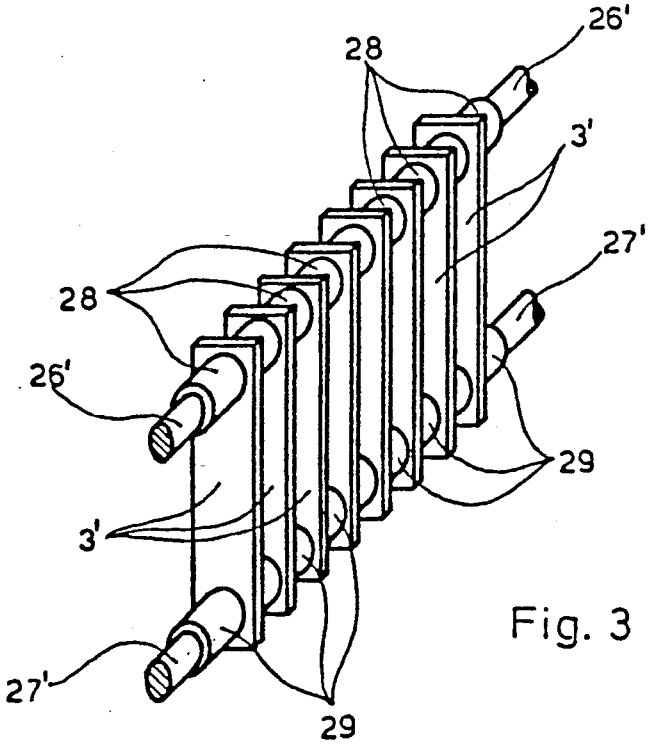
FIG. 3 is a perspective view of one of the constituent prefabricated packs of a modified embodiment of the reed according to the invention.

Finally, according to a modification of the invention (see specifically FIG. 3), the blades 3' of the pack are fixed spaced apart on two hollow auxiliary supports 28 and 29 into which removable pins 26' and 27' are inserted for connecting the blade packs together.

We claim:

1. A bladed loom reed including a support base for internally supporting at least two preassembled packs of blades, each preassembled pack being of a predetermined lenght and comprising a succession of blades which are fixedly bonded to one another by a bonding means wherein each of the preassembled packs are arranged on the support base to be individually inserted or removed therefrom.

2. A bladed loom reed according to claim 1, wherein the blades of the preassembled packs are spaced apart by means of spacers and each preassembled pack comprises a succession of blades and spacers which are fixedly bonded together.

3. A bladed loom reed according to claim 1, wherein the preassembled packs comprises a succession of blades which are fixedly bonded onto an auxiliary support.

4. A bladed loom reed according to claim 3, wherein the blades of the preassembled packs are spaced apart by means of spacers and wherein the blades and spacers are bonded onto the auxiliary support.

5. A blade loom reed according to claim 1, wherein the blades are in the preassembled packs are welded together.

6. A blade loom reed according to claim 2, wherein the spacers and blades in the preassembled packs are welded together.

7. A blade loom reed according to claim 3, wherein the blades of the preassembled packs are welded onto the auxiliary support.

8. A bladed loom reed according to claim 4, wherein the blades and spacers of the preassembled packs are welded onto the auxiliary support.

* * * * *